US009508357B1

(12) United States Patent
Krishnaswamy

(10) Patent No.: US 9,508,357 B1
(45) Date of Patent: Nov. 29, 2016

(54) SYSTEM AND METHOD OF OPTIMIZING A BEAMFORMER FOR ECHO CONTROL

(71) Applicant: Apple Inc., Cupertino, CA (US)

(72) Inventor: Arvindh Krishnaswamy, San Jose, CA (US)

(73) Assignee: Apple Inc., Cupertino, CA (US)

( * ) Notice: Subject to any disclaimer, the term of this patent is extended or adjusted under 35 U.S.C. 154(b) by 155 days.

(21) Appl. No.: 14/550,868

(22) Filed: Nov. 21, 2014

(51) Int. Cl.
*G10L 21/02* (2013.01)

(52) U.S. Cl.
CPC ..... *G10L 21/02* (2013.01)

(58) Field of Classification Search
None
See application file for complete search history.

(56) References Cited

U.S. PATENT DOCUMENTS

2014/0023199 A1 1/2014 Giesbrecht
2014/0056435 A1 2/2014 Kjems et al.
2014/0093093 A1* 4/2014 Dusan ..... H04R 3/005 381/74
2014/0112487 A1 4/2014 Laska et al.
2015/0371657 A1* 12/2015 Gao ..... G10K 11/16 381/66

* cited by examiner

*Primary Examiner* — Paul Huber
(74) *Attorney, Agent, or Firm* — Blakely, Sokoloff, Taylor & Zafman LLP

(57) ABSTRACT

Apparatus for optimizing beamformers for echo control comprises microphones to receive acoustic signals, echo cancellers (ECs) respectively coupled to the microphones to adaptively cancel echo in the acoustic signals and to generate EC-acoustic signals, and a first fixed beamformer coupled to the ECs to receive the EC-acoustic signals. The null of the first beamformer is steered in a direction of a first environmental noise source that is determined offline by exciting the ECs with normal speech signals and audio playback signals to cause the ECs to generate test EC-acoustic signals, and selecting the first environmental noise source based on loudness weighted centroids of noise in the test EC-acoustic signals. Apparatus may also include a residual echo suppressor coupled to the first fixed beamformer to perform echo suppression on output of the first fixed beamformer and to generate clean signal. Other embodiments are also described.

23 Claims, 7 Drawing Sheets

SYSTEM AND METHOD OF OPTIMIZING A BEAMFORMER FOR ECHO CONTROL

FIELD

An embodiment of the invention relate generally to an electronic device including a beamformer that is optimized for echo control with non-linearities and multiple non-linear coupling paths. In some embodiments, the beamformer is fixed to have its nulls steered towards the significant locations of environmental noises, which are identified and located using offline training.

BACKGROUND

Currently, a number of consumer electronic devices are adapted to receive speech from a near-end talker (or environment) via microphone ports, transmit this signal to a far-end device, and concurrently output audio signals, including a far-end talker, that are received from a far-end device. While the typical example is a portable telecommunications device (mobile telephone), with the advent of Voice over IP (VoIP), desktop computers, laptop computers and tablet computers may also be used to perform voice communications.

In these full-duplex communication devices, where both parties can communicate to the other simultaneously, the downlink signal that is output from the loudspeaker may be captured or acquired by the microphone. Accordingly, the downlink signal sent back to the far-end device as echo. This echo occurs due to the natural coupling between the microphone and the loudspeaker in electronic devices. The natural coupling may occur, for instance, when the microphone and the loudspeakers are in close proximity, when loud playback levels are being used, and when the microphones in the electronic devices are highly sensitive.

This echo, which can occur concurrently with the desired near-end speech, often renders the user's speech difficult to understand, and even unintelligible is such feedback loops though multiple near-end/far-end playback and acquisition cycles. Therefore, echo degrades the quality of the voice communication.

SUMMARY

Generally, the invention relates to an apparatus and a method of optimizing beamformers for echo control by determining offline the environmental noise source(s) and using at least one fixed beamformer that has a null being steered in the direction of at least one environmental noise source, respectively. The environmental noise sources may be noise sources that occur statistically most frequently and/or the noise sources that generate the loudest noise.

In one embodiment of the invention, an apparatus for optimizing beamformers for echo control comprises a plurality of microphones to receive acoustic signals, a plurality of echo cancellers (ECs) coupled to the plurality of microphones, respectively, to converge and adaptively cancel echo in the acoustic signals and to generate EC-acoustic signals, and a first fixed beamformer coupled to the plurality of ECs to receive the EC-acoustic signals. The null of the first beamformer is steered in a direction of a first environmental noise source that is determined offline by exciting the ECs with normal speech signals and audio playback signals to cause the ECs to generate test EC-acoustic signals, and selecting the first environmental noise source based on loudness weighted centroids of noise in the test EC-acoustic signals. The apparatus may also include a residual echo suppressor coupled to the first fixed beamformer to perform echo suppression on an output of the first fixed beamformer and to generate a clean signal.

In another embodiment of the invention, a method of optimizing beamformers for echo control starts by setting a null for a first fixed beamformer offline. Setting the null may include determining a first environmental noise source offline by: (i) exciting a plurality of echo cancellers (ECs) coupled to a plurality of microphones, respectively, with normal speech signals and audio playback signals to cause the ECs to generate test EC-acoustic signals, and (ii) selecting the first environmental noise source based on loudness weighted centroids of noise in the test EC-acoustic signals. The null of the first fixed beamformer is then set in a direction of the first environmental noise source. The ECs then converge and adaptively cancel echo in the acoustic signals received from the plurality of microphones to generate EC-acoustic signals. The first fixed beamformer then receives the EC-acoustic signals and the null of the first fixed beamformer is steered in the direction of the first environmental noise.

In one embodiment, a non-transitory computer-readable storage medium having stored thereon instructions, which when executed by a processor, causes the processor to perform the method of optimizing a beamformer for echo control in an electronic device.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

Figure 1:
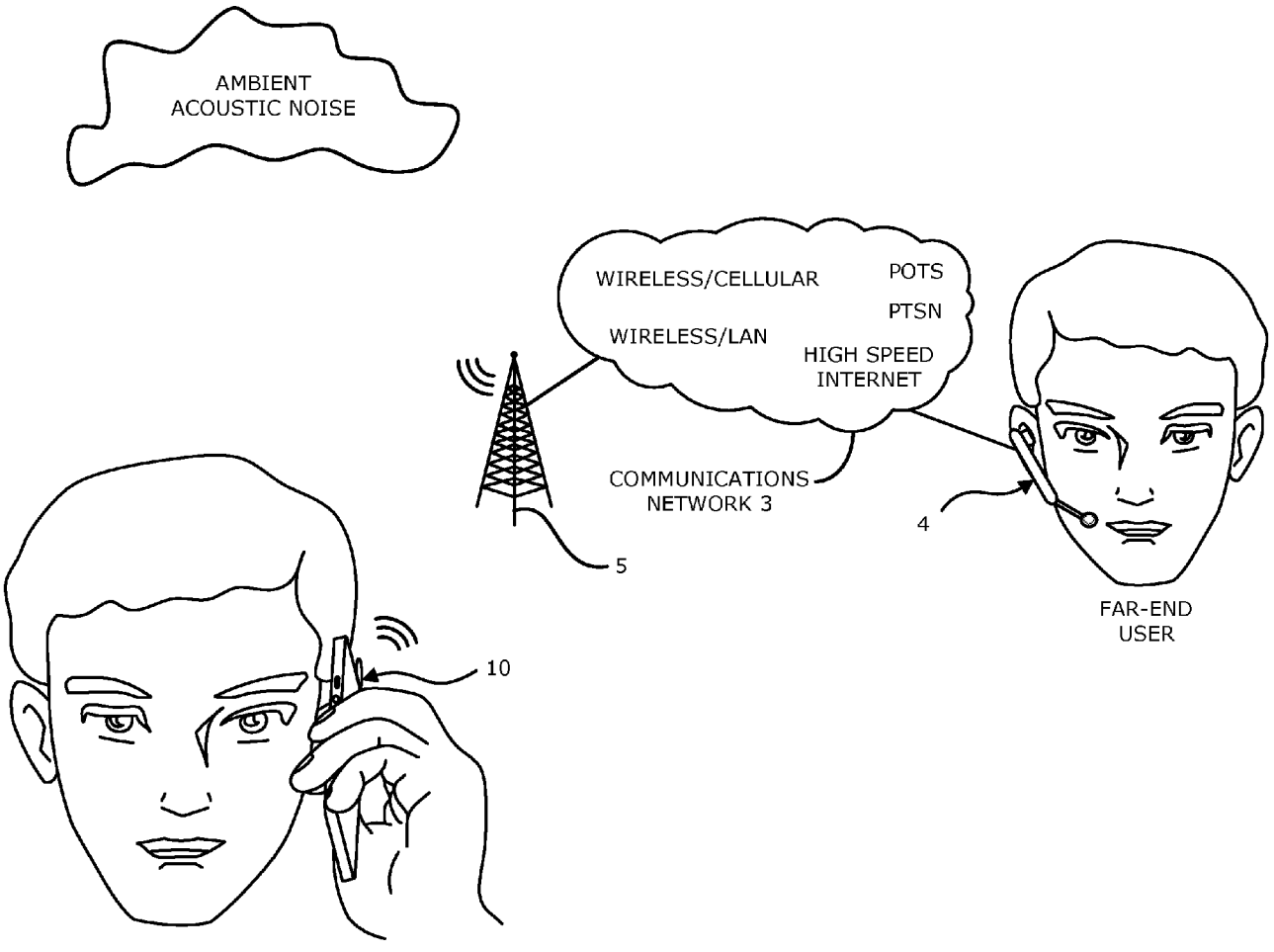
FIG. 1 illustrates an example of an electronic device in which an embodiment of the invention may be implemented.

FIG. 1 illustrates an instance of an electronic device 10 in which an embodiment of the invention may be implemented. As shown in FIG. 1, the electronic device 10 may be a mobile telephone communications device (or mobile device) or a smartphone. However, the electronic device 10 may also be, for instance, a desktop computer, a tablet computer, a personal digital media player, a notebook computer, and laptop computer. In the embodiment in FIG. 1, the near-end user is in the process of a call with a far-end user who is using another communications device 4. The term "call" is used here generically to refer to any two-way real-time or live audio communications session with a far-end user (including a video call which allows simultaneous audio). The electronic device 10 communicates with a wireless base station 5 in the initial segment of its communication link. The call, however, may be conducted through multiple segments over one or more communication networks 3, e.g. a wireless cellular network, a wireless local area network, a wide area network such as the Internet, and a public switch telephone network such as the plain old telephone system (POTS). The far-end user need not be using a mobile device, but instead may be using a landline based POTS or Internet telephony station.

As shown in FIG. 1, the device 10 may include a housing that includes a display screen 16 on the front face of the device 10. The display screen 16 may be a touch screen. The device 10 may also include input-output components such as ports and jacks. For example, the device 10 may include a first opening to form the microphone port and a second opening to form a speaker port. The sound during a telephone call is emitted through a third opening which forms a speaker port for a telephone receiver that is placed adjacent to the user's ear during a call. Further, when the device is used in speakerphone mode, for example, the openings may be used as speaker ports to output the audio signals. In some embodiments, the user may use a headset that includes a pair of earbuds and a headset wire. The user may place one or both the earbuds into his ears to receive the audio content. The headset wire may also include a plurality of microphones. As the user is using the headset to transmit his speech, environmental noise may also be present. Additionally, embodiments of the invention may also use other types of headsets.

The housing of the device 10 may include therein components such as a loudspeaker and at least one microphone. The loudspeaker is driven by an output downlink signal that includes the far-end acoustic signal components. The microphones may be air interface sound pickup devices that convert sound into an electrical signal. As the near-end user is using the electronic device 10 to transmit his speech, ambient noise may also be present. Thus, the microphone captures the near-end user's speech as well as the ambient noise around the electronic device 10. The downlink signal that is output from a loudspeaker may also environmental noise that is captured by the microphone, and if so, the downlink signal that is output from the loudspeaker could get fed back in the near-end device's uplink signal to the far-end device's downlink signal. This downlink signal would in part drive the far-end device's loudspeaker, and thus, components of this downlink signal would be included in the near-end device's uplink signal to the far-end device's downlink signal as echo.

In an effort to eliminate the echo from the far-end device's downlink signal, current solutions aim to use adaptive filters to slowly converge and cancel the downlink signal that is output from the near-end device's loudspeaker. However, these current solutions are ineffective because the loudspeaker in the electronic device is not a linear device. The output of the loudspeaker changes and becomes non-linear as the audio content being outputted changes. For instance, a sine wave at full amplitude at 300 Hz may cause non-linear problems while a sine wave at full amplitude at 2 kHz may not cause any non-linear problems. Further, the internal mechanical coupling of the loudspeaker may also be different for each frequency. For instance, each of the physical components in the electronic component may form a non-linear component that varies based on frequency of the outputted content. The physical components may include, for example, the SIM card tray, the camera spring, the vibration component, etc. Accordingly, the convergence of linear adaptive filters is dependent on the frequency of the outputted content as well as the physical components in the electronic component itself.

Figure 2A:
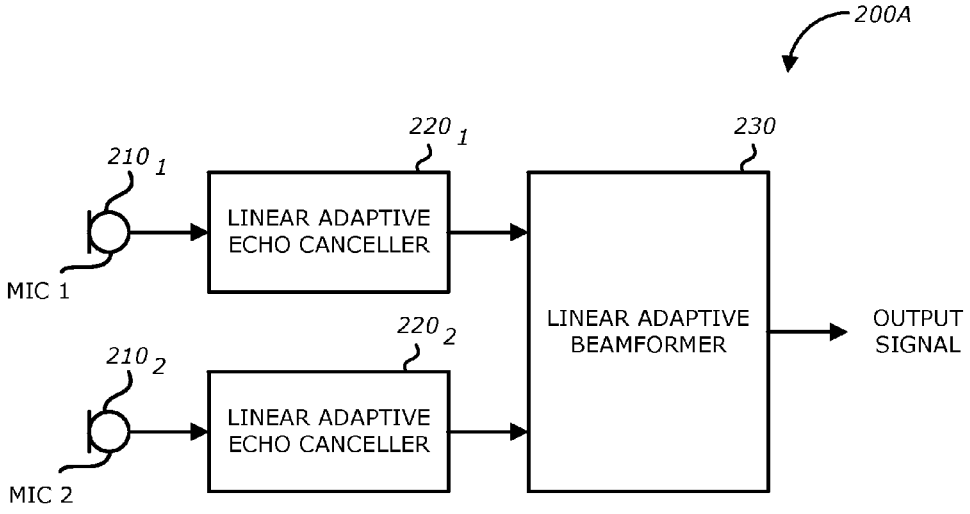
PRIOR ART FIG. 2A
FIGS. 2A-2B illustrate block diagrams of prior art systems for echo control.
Figure 2B:
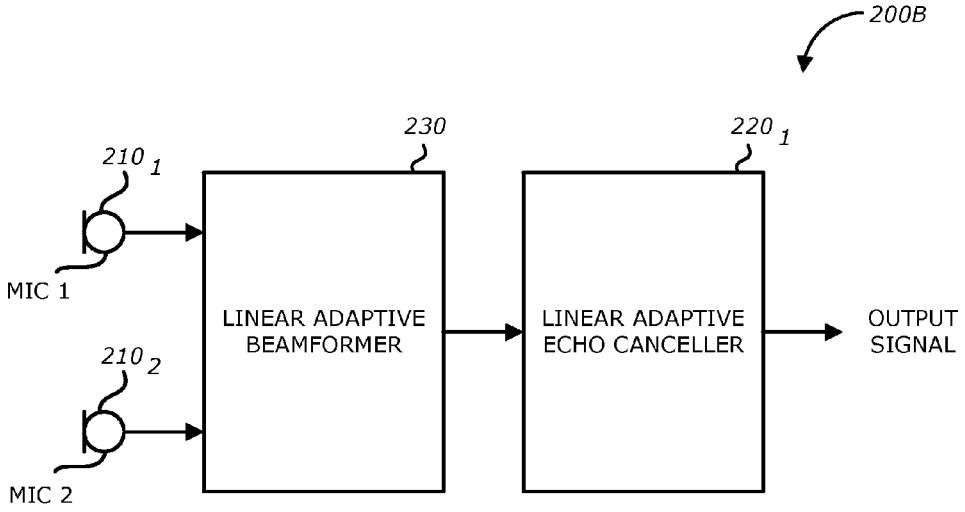
PRIOR ART FIG. 2B

FIGS. 2A-2B illustrate block diagrams of prior art systems that have difficulties providing effective echo control in certain situations. In FIG. 2A, the prior art system 200A includes a pair of microphones $\mathbf{210}_1$, $\mathbf{210}_2$, a first and second linear adaptive echo cancellers (ECs) $\mathbf{220}_1$, $\mathbf{220}_2$, and a linear adaptive beamformer 230. The microphones $\mathbf{210}_1$, $\mathbf{210}_2$ receive acoustic signals that include the near-end user's voice as well as the downlink signal that is output from the near-end device's loudspeaker (e.g., the echo in the far-end device's downlink signal). The microphones $\mathbf{210}_1$, $\mathbf{210}_2$ are coupled to a first and second linear adaptive ECs $\mathbf{220}_1$, $\mathbf{220}_2$, respectively, which are adaptive filters that converge in order to cancel the downlink signal that is output from the near-end device's loudspeaker. The output of the linear adaptive ECs $\mathbf{220}_1$, $\mathbf{220}_2$ is received by the linear adaptive beamformer 230 that also includes an adaptive filter that is adaptively steered to set the null of the beamformer 230 to further reduce the echo in the uplink signal being transmitted to the far-end device (e.g., the echo in the far-end device's downlink signal). The linear adaptive beamformer 230 processes the linear adaptive ECs $\mathbf{220}_1$, $\mathbf{220}_2$ outputs in order to output an echo-reduced signal. The null of the linear adaptive beamformer 230 is adaptively steered in the directions of the echo in order to deemphasize the echo using the null. The linear adaptive ECs $\mathbf{220}_1$, $\mathbf{220}_2$ are very sensitive and converge quickly such that the linear adaptive ECs $\mathbf{220}_1$, $\mathbf{220}_2$ will be greatly affected by changes to its inputs. In the system 200A, the linear adaptive beamformer 230 is coupled to the outputs of the linear adaptive ECs $\mathbf{220}_1$, $\mathbf{220}_2$ such that it does not cause convergence issues to the linear adaptive ECs $\mathbf{220}_1$, $\mathbf{220}_2$. However, when the linear adaptive ECs $\mathbf{220}_1$, $\mathbf{220}_2$ receive acoustic signals from the microphones $\mathbf{210}_1$, $\mathbf{210}_2$ that include significant amounts of residual echo, the linear adaptive ECs $\mathbf{220}_1$, $\mathbf{220}_2$ will continue to adapt and converge to cancel the residual echo (e.g., echo path changes). Accordingly, the changing input to the linear adaptive beamformer 230 will cause the linear adaptive beamformer 230 to continuously adapt to the echo path changes. In other words, since the linear adaptive ECs $\mathbf{220}_1$, $\mathbf{220}_2$ do not fully converge when the residual echo is significant, the linear adaptive beamformer 230 is unable to set its null to remove the echo (e.g., environmental noise). The system 200A may be effective when the acoustic signals from the microphones $\mathbf{210}_1$, $\mathbf{210}_2$ include minimal amounts of residual echo since the linear adaptive ECs $\mathbf{220}_1$, $\mathbf{220}_2$ are able to fully converge.

In FIG. 2B, the prior art system 200B also includes a pair of microphones $\mathbf{210}_1$, $\mathbf{210}_2$, a first linear adaptive EC $\mathbf{220}_1$, and a linear adaptive beamformer 230. In contrast to the system 200A in FIG. 2A, the linear adaptive beamformer 230 is coupled to the microphones $\mathbf{210}_1$, $\mathbf{210}_2$ to receive the acoustic signals that include the near-end user's voice as well as the downlink signal that is output from the near-end device's loudspeaker (e.g., the echo in the far-end device's downlink signal). The linear adaptive beamformer 230 adapts its beamforming pattern to remove the location of downlink signal that is output from the near-end device's loudspeaker (e.g., the echo). However, given the non-linearities of the loudspeaker and the echo in the audio signals received, the linear adaptive beamformer 230 may constantly be adapting its beamforming patterns and thus its outputs may constantly be changing. In other words, the linear adaptive beamformer 230 may not fully converge. In contrast to the system 200A, the linear adaptive ECs $\mathbf{220}_1$, $\mathbf{220}_2$ receive as inputs the output of the linear adaptive beamformer 230. Since the linear adaptive ECs $\mathbf{220}_1$, $\mathbf{220}_2$ are very sensitive and converge quickly, the linear adaptive ECs $\mathbf{220}_1$, $\mathbf{220}_2$ will be greatly affected by constant changes to its inputs from the linear adaptive beamformer 230. Accordingly, the linear adaptive EC $\mathbf{220}_1$ in system 200B will constantly be converging quickly and not be able to cancel the echo in the linear adaptive beamformer 230's output.

Figure 3:
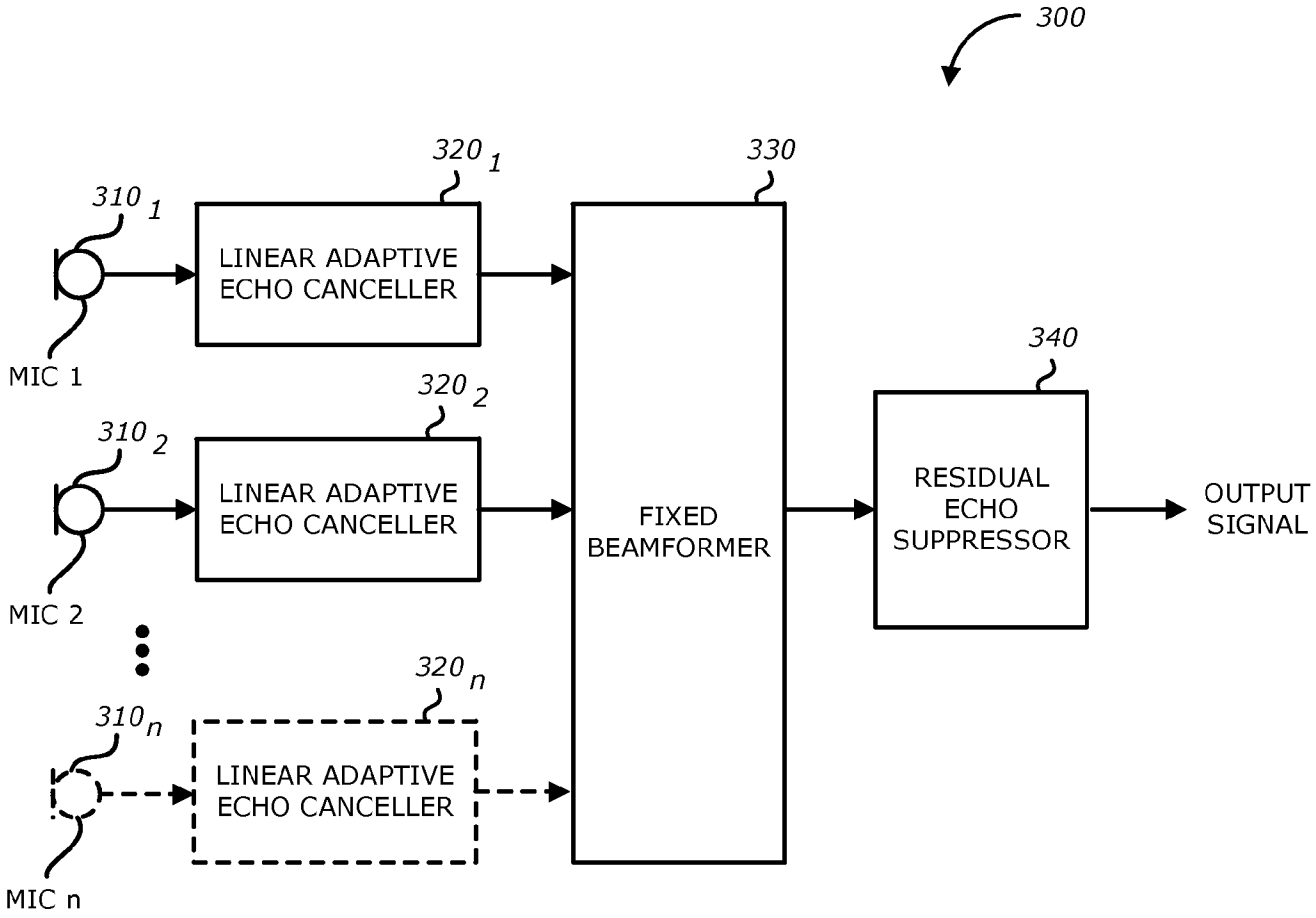
FIG. 3 illustrates a block diagram of a system for optimizing a beamformer for echo control according to one embodiment of the invention.
Figure 5:
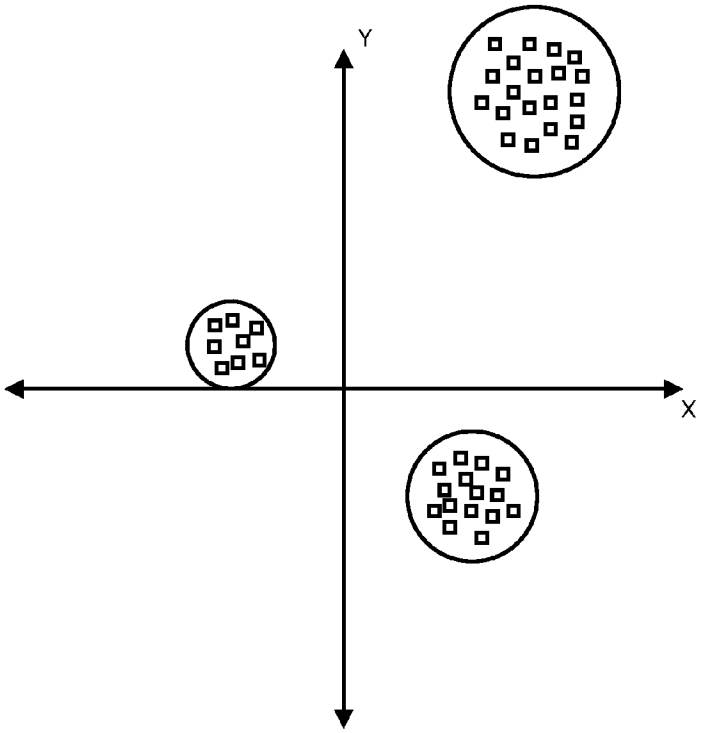
FIG. 5 illustrates an example of a scatter plot used to locate of environmental noise sources offline according to one embodiment of the invention.

FIG. 3 illustrates a block diagram of a system 300 for optimizing a beamformer for echo control according to one embodiment of the invention, which addresses the shortcomings of the prior art systems 200A and 200B. The system 300 may be included in electronic device 10. The system 300, as shown in FIG. 3, includes a plurality of microphones $\mathbf{310}_1$-$\mathbf{310}_n$ (n>1), a plurality of linear adaptive ECs $\mathbf{320}_1$-$\mathbf{320}_n$, a fixed beamformer 330, and a residual echo suppressor (ES) 340. In the system 300, the microphones $\mathbf{310}_1$-$\mathbf{310}_n$ receive the acoustic signals, and the linear adaptive ECs $\mathbf{320}_1$-$\mathbf{320}_n$ are coupled to the microphones $\mathbf{310}_1$-$\mathbf{310}_n$, respectively, to adaptively cancel echo in the acoustic signals to generate EC-acoustic signals. The linear adaptive ECs $\mathbf{320}_1$-$\mathbf{320}_n$ may converge to cancel the echo in the acoustic signals. In contrast to FIG. 2A, the system 300 in FIG. 3 includes a fixed beamformer 330 which is coupled to the ECs to receive the EC-acoustic signals. To overcome the situation wherein the beamformer 230 is constantly adapting to a moving target from the ECs given the echo path changes, the fixed beamformer 330 is set and not adaptively beamforming. Instead, the fixed beamformer 330 is set such that the null of the fixed beamformer is steered in a direction of an environmental noise source (e.g., the echo from the downlink signal being output from the near-end device's loudspeaker). Accordingly, the fixed beamformer 330 may deemphasize the location of the echo using the nulls. In some embodiments, the fixed beamformer 330 may form a cardioid pattern. To determine the location of the environmental noise source and direct the null of the fixed beamformer 330 requires offline determinations and tests. For instance, the outputs of the linear adaptive ECs $\mathbf{320}_1$-$\mathbf{320}_n$ (e.g., the inputs of the fixed beamformer 330) may be tapped to assess and determine the space where statistically it is most likely that there is the most significant echo energy on a per frequency basis or on a per loudness basis. For example, FIG. 5 illustrates an example of a scatter plot that is used to locate of environmental noise sources offline according to one embodiment of the invention. Based on where the clusters of echo energy are located, the most significant environmental noise sources may be identified offline.

In one embodiment, the environmental noise source is determined offline by exciting the ECs with normal speech signals and audio playback signals to cause the ECs to generate test EC-acoustic signals. Accordingly, the normal speech signals and audio playback signals are received by the ECs, the ECs adaptively converge and perform echo cancellation on the received signals and generate the test EC-acoustic signals. A source direction detector or a processor may tap the output of the linear adaptive ECs to receive these test EC-acoustic signals and may select the environmental noise source based on loudness weighted centroids of noise in the test EC-acoustic signals. In some embodiments, the environmental noise source that is selected is the environmental noise source having the highest power.

In one embodiment, a source direction detector (not shown) may tap the output of the ECs $\mathbf{320}_1$-$\mathbf{320}_n$ and may perform acoustic source localization based on time-delay estimates in which pairs of microphones included in the plurality of microphones $\mathbf{310}_1$-$\mathbf{310}_n$, are used to estimate the delay for the sound signal between the two of the microphones. The delays from the pairs of microphones may also be combined and used to estimate the source location using methods such as the generalized cross-correlation (GCC) or adaptive eigenvalue decomposition (AED). In another embodiment, the source direction detector and the fixed beamformer 330 may work in conjunction offline to perform the source localization based on steered beamforming (SBF). In this embodiment, the fixed beamformer 330 is steered over a range of directions and for each direction the power of the beamforming output is calculated. The power of the fixed beamformer 330 for each direction in the range of directions is calculated and the environmental noise source is detected as the direction that has the highest power.

Figure 4:
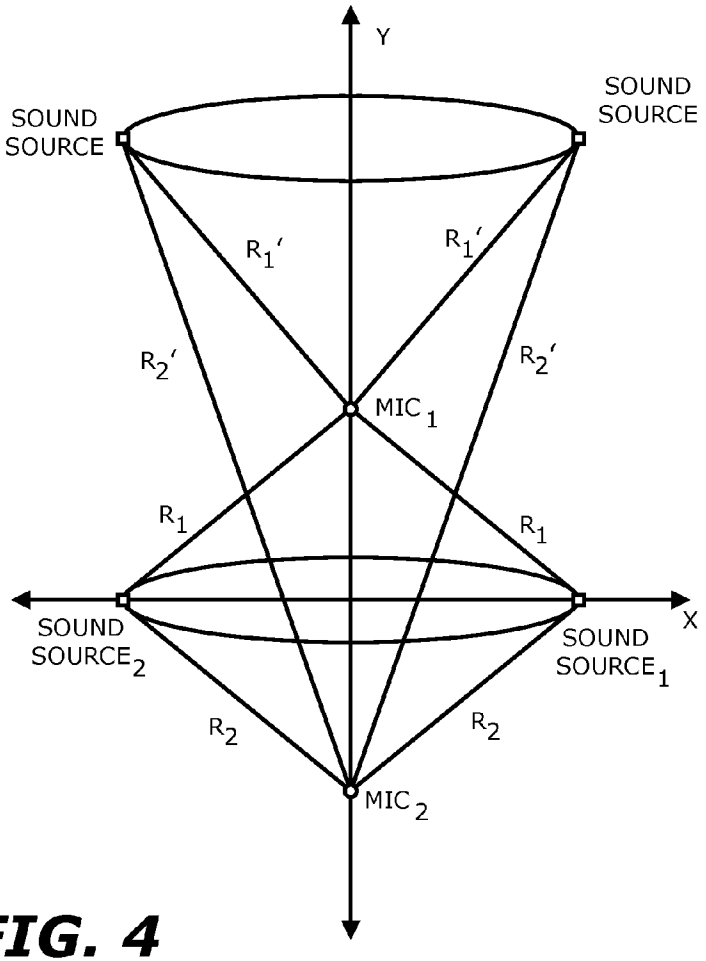
FIG. 4 illustrates a top view of an example of locating of environmental noise sources offline according to one embodiment of the invention.

FIG. 4 illustrates a top view of an example of locating of environmental noise sources offline according to one embodiment of the invention. FIG. 4 illustrates the location of a plurality of noise sources (marked as squares) and two of the microphones $\mathbf{310}_1$, $\mathbf{310}_2$ (marked as circles). In FIG. 4, the noise sources on the x-axis are equal in distance to microphones $\mathbf{310}_1$, $\mathbf{310}_2$. Specifically, the distances $R_1$ between the sound sources and the first microphone $\mathbf{310}_1$, respectively, are equal and the distances $R_2$ between the sound sources and the second microphone $\mathbf{310}_2$, respectively, are equal. Accordingly, the time of arrival to each of the microphones $\mathbf{310}_1$, $\mathbf{310}_2$ of the sound from the noise sources on the x-axis that are respectively equal since the distances travelled are equal (e.g., $R_1$ is equal to $R_1$ and $R_2$ is equal to $R_2$). Similarly, the sound sources that are above the x-axis are also equal in distance to microphones $\mathbf{310}_1$, $\mathbf{310}_2$ (e.g., $R_1'$ is equal to $R_1'$ and $R_2'$ is equal to $R_2'$). As shown in FIG. 4, a circle may be drawn to connect the sound sources that are equal distances to the microphones $\mathbf{310}_1$, $\mathbf{310}_2$ (e.g., $R_1'$ is equal to $R_1'$ and $R_2'$ is equal to $R_2'$). Therefore, the times of arrival to each of the microphones $\mathbf{310}_1$, $\mathbf{310}_2$, respectively, are equal for any sound source located on the circle. Accordingly, by using the difference of time of arrival to the first microphone $310_1$ and time of arrival to the second microphone $310_2$ (e.g., relative phase), the angle at which the noise source is located may be identified (e.g., in the cone in FIG. 4). In some embodiments, the fixed beamformer 330 is then set offline to null out the angle at which the noise source is located. In another embodiment, in order to further determine the distance at which the noise source is located, the energy loss of the noise received at the microphones $310_1$, $310_2$ is used. If the noise source is far from the microphones $310_1$, $310_2$, the $1/R^2$ energy loss is small, whereas if the noise source is close to the microphones $310_1$, $310_2$, the $1/R^2$ energy loss is larger. In this embodiment, the fixed beamformer 330 may be optimized by fixing the beamformer to null out the angle and the distance at which the noise source is located. As shown in FIG. 5, the test EC-acoustic signals per frequency bin are generated by the converged ECs $320_1$, $320_2$ and are used to generate a scatter plot or heat map of combined relative magnitude and relative phase of the noise source location in real space. In some embodiments, the ECs $320_1$, $320_2$ are fully converged and generate the test-acoustic signals. In other embodiments, the ECs $320_1$, $320_2$ adaptively converge and generate the test-acoustic signals. Loudness weighted centroids may be used to tune the fixed beamformer 330 offline. Accordingly, the fixed beamformer 330 may be set to target the location of the most significant part of the residual echo, including all the ECs and other non-linear effects due to the loudspeaker and the echo path. The most significant part of the echo may be a most significant noise source location. For instance, the most significant noise source location may be the location where it is determined offline statistically the noise occurs more frequently or where the noise source is the loudest (e.g., having the highest power). The perceptual impact of each of the noise sources may also be determined in order to select the noise source to which the fixed beamformer should be directed.

Referring back to FIG. 3, the system 300 also includes a residual echo suppressor 340 coupled to the first fixed beamformer to perform echo suppression on an output of the fixed beamformer to generate a clean signal. In one embodiment, the system 300 also includes the loudspeaker (not shown) to output a loudspeaker signal that includes a downlink audio signal from a far-end talker. In this embodiment, the first environmental noise is the output from the loudspeaker.

Figure 6:
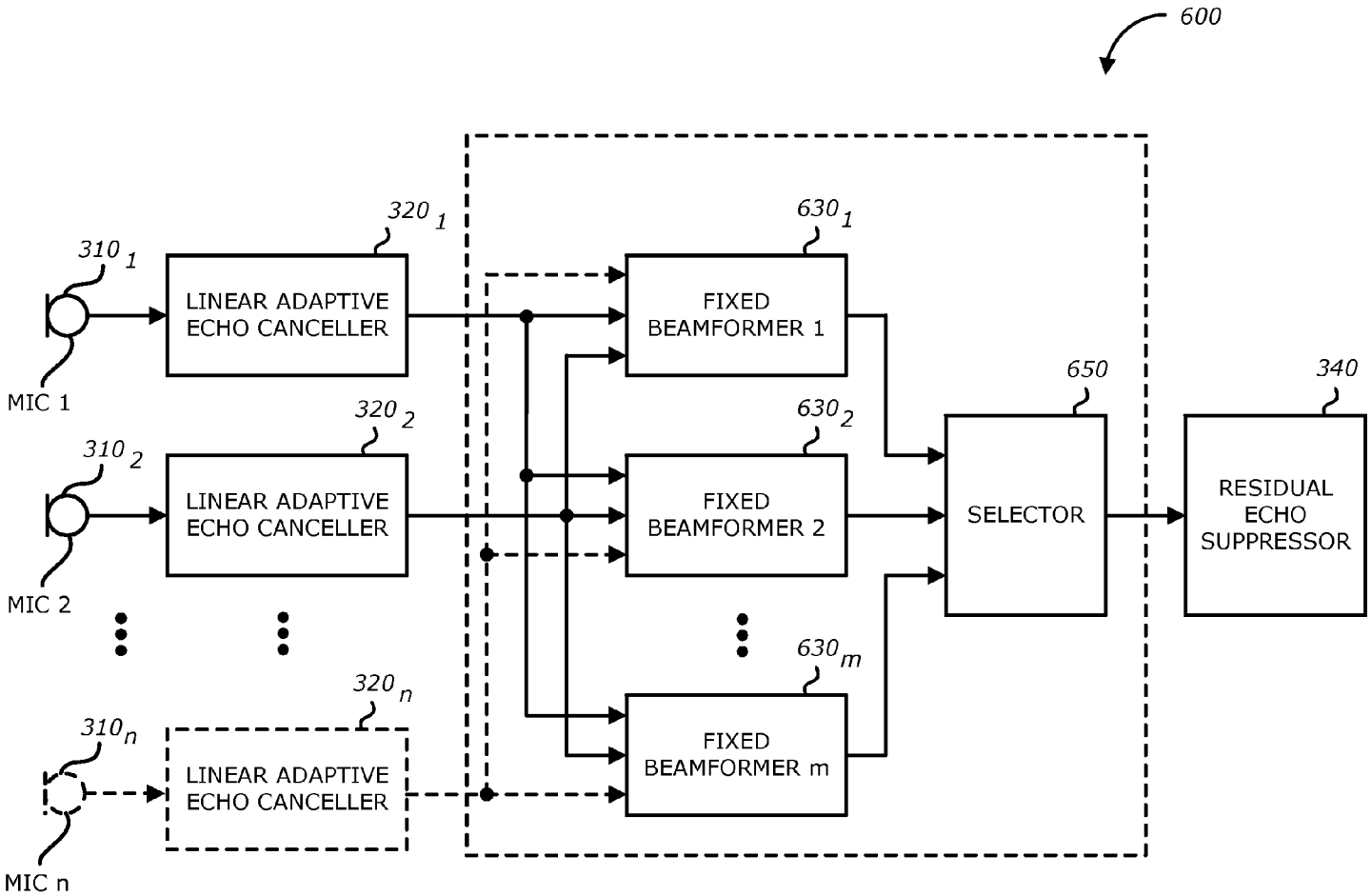
FIG. 6 illustrates a block diagram of a system for optimizing beamformers for echo control according to another embodiment of the invention.

FIG. 6 illustrates a block diagram of a system 600 for optimizing beamformers for echo control according to another embodiment of the invention. The system 600 may be included in electronic device 10. In contrast to the system 300 in FIG. 3, the system 600 includes a plurality of fixed beamformers $630_1$-$630_m$ (m>1) and a selector 650 instead of the single fixed beamformer 330. The system 600, as shown in FIG. 6, also includes a plurality of microphones $310_1$-$310_n$ (n>1), a plurality of linear adaptive ECs $320_1$-$320_n$, and a residual echo suppressor (ES) 340. In the system 600, the microphones $310_1$-$310_n$ receive the acoustic signals, and the linear adaptive ECs $320_1$-$320_n$ are coupled to the microphones $310_1$-$310_n$, respectively, to converge and adaptively cancel echo in the acoustic signals to generate EC-acoustic signals. In contrast to FIG. 3, the plurality of fixed beamformers $630_1$-$630_m$ are coupled to the ECs $320_1$-$320_n$ to receive the EC-acoustic signals. Each of the fixed beamformers $630_1$-$630_m$ may be directed to a different environmental noise source. For instance, referring to FIG. 5, each of the clusters in the scatter plot represents a noise source that is significant based on the loudness weighted centroids and/or based on whether the noise (e.g., echo) from that noise source is statistically likely to occur. Each of the fixed beamformers $630_1$-$630_m$ may be set such that their respective nulls are directed to each of the noise sources in FIG. 5, respectively (e.g., locations of each of the clusters). Each of the fixed beamformers $630_1$-$630_m$ process the EC-acoustic signals, respectively, to further remove the noise (e.g., echo) from the EC-acoustic signals and the outputs of the fixed beamformers $630_1$-$630_m$ are received by a selector 650. In one embodiment, the selector 650 may select and output one of the outputs from the fixed beamformers $630_1$-$630_m$. In this embodiment, the selector 650 may determine and select the output that includes the least amount of noise (e.g., echo). In another embodiment, the selector 650 combines the outputs from the beamformers $630_1$-$630_m$ to generate a selector output. The selector output may be an EC-acoustic signal having had the noise from each of the significant noise sources removed. As shown in FIG. 6, the residual echo suppressor 340 receives the output of the selector 650 and performs echo suppression to remove the residual noise (e.g., echo) from the signal output from the selector 650 to generate a cleaned signal.

Moreover, the following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 7:
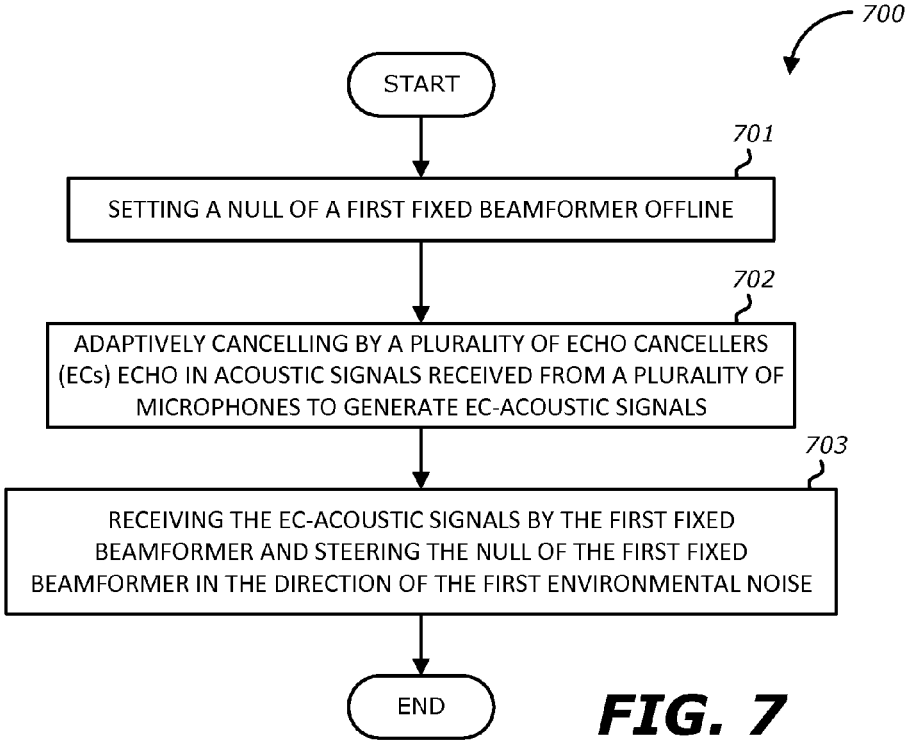
FIG. 7 illustrates a flow diagram of an example method of optimizing a beamformer for echo control according to one embodiment of the invention.

FIG. 7 illustrates a flow diagram of an example method 700 of optimizing a beamformer for echo control according to one embodiment of the invention. The method 700 starts by setting the null of a first fixed beamformer offline at Block 701. At Block 702, ECs may converge and adaptively cancel echo in acoustic signals that are received from a plurality of microphones to generate EC-acoustic signals. At Block 703, the first fixed beamformer receives the EC-acoustic signals and the null of the first beamformer is steered in the direction of the first environmental noise. In some embodiments, a residual echo suppressor then receives the output of the first fixed beamformer and performs echo suppression on the output of the first fixed beamformer to generate a clean signal.

Figure 8:
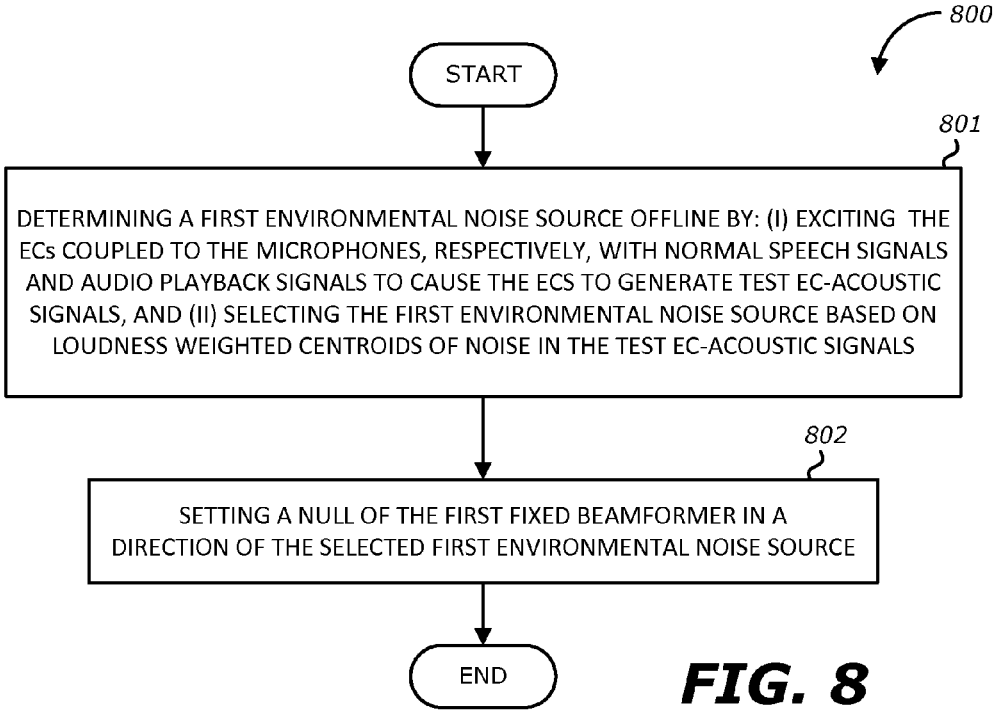
FIG. 8 illustrates a flow diagram of the details of setting a null of a fixed beamformer from FIG. 7 according to one embodiment of the invention.

Referring to FIG. 8, a flow diagram of the details of setting a null of a fixed beamformer from Block 701 in FIG. 7 according to one embodiment of the invention is illustrated. At Block 801, the first environmental noise source is determine offline by exciting the ECs that are coupled to the plurality of microphones, respectively, with normal speech signals and audio playback signals to cause the ECs to generate test EC-signals. The first environmental noise source is then selected based on loudness weighted centroid of noise in the test EC-acoustic signals. In some embodiments, selecting the first environmental noise source includes determining a statistical occurrence of each of the environmental noise sources, determining the loudness of each of the environmental noise sources, and/or determining the perceptual impact of each of the environmental noise sources. The first environmental noise may be an output from a loudspeaker. The loudspeaker may output a loudspeaker signal that includes a downlink audio signal from a far-end talker (e.g., echo). Accordingly, in this embodiment, the first environmental noise source is the location of the output from the loudspeaker. In one embodiment, the first environmental noise source is selected from the plurality of environmental noise sources and the first environmental noise source is the environmental noise source having a highest power in the EC-acoustic signals. At Block 802, the null of the first fixed beamformer is set in the direction of the selected first environmental noise source.

In one embodiment, method 700 in FIG. 7 further includes setting a null of a second fixed beamformer offline in a direction of a second environmental noise source similar to the setting of the null offline for the first fixed beamformer as described above. The second environmental noise source may be another environmental noise source that is significant in that it may also create an echo in the far-end device's downstream signal. The second environmental noise source may also be selected based on its loudness, statistical occurrence, or perceptual impact. In this embodiment, a method may further include selecting and outputting by a selector one of an output of the first fixed beamformer or an output of the second fixed beamformer. In another embodiment, the selector may combine the outputs of the first and second fixed beamformers to generate a selector output.

Figure 9:
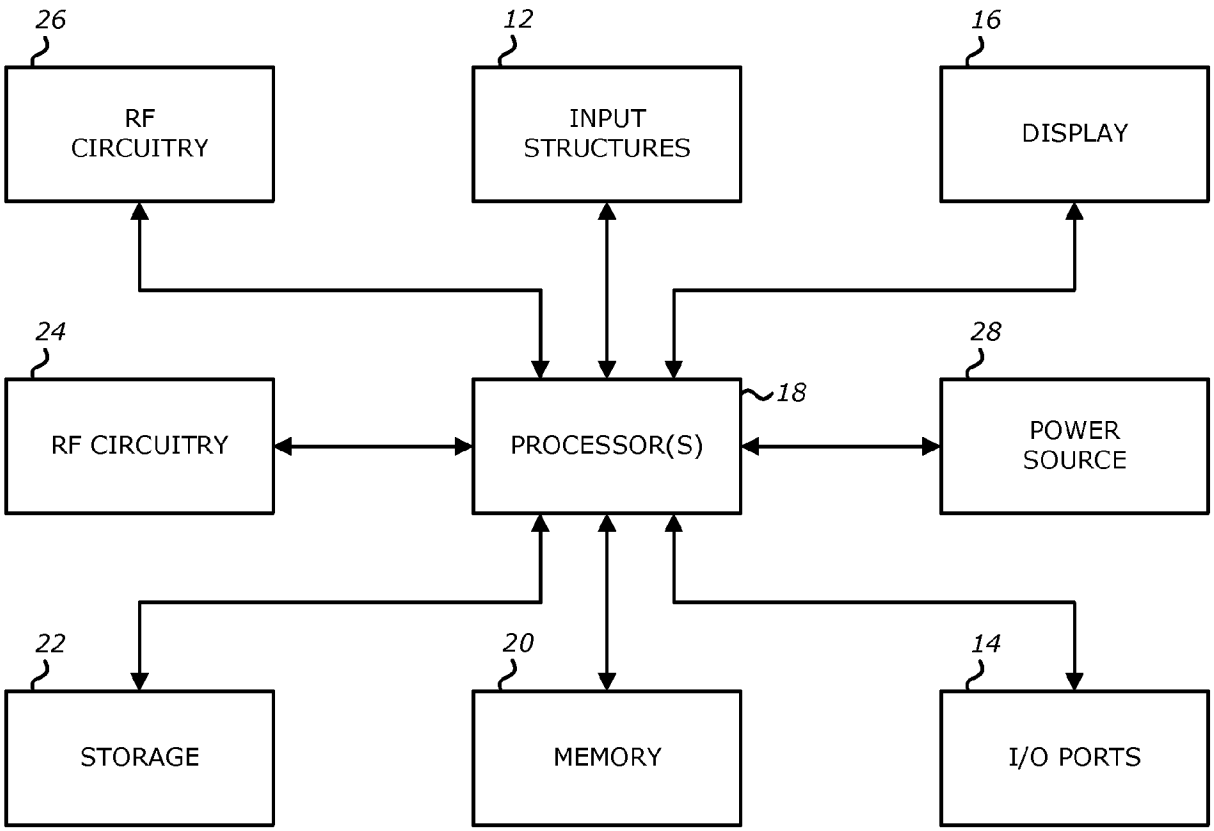
FIG. 9 is a block diagram of exemplary components of an electronic device for optimizing a beamformer for echo control in accordance with aspects of the present disclosure.

A general description of suitable electronic devices for performing these functions is provided below with respect to FIG. 9. Specifically, FIG. 9 is a block diagram depicting various components that may be present in electronic devices suitable for use with the present techniques. The electronic device may be in the form of a computer, a handheld portable electronic device, and/or a computing device having a tablet-style form factor. These types of electronic devices, as well as other electronic devices providing comparable speech recognition capabilities may be used in conjunction with the present techniques.

Keeping the above points in mind, FIG. 9 is a block diagram illustrating components that may be present in one such electronic device 10, and which may allow the device 10 to function in accordance with the techniques discussed herein. The various functional blocks shown in FIG. 9 may include hardware elements (including circuitry), software elements (including computer code stored on a computer-readable medium, such as a hard drive or system memory), or a combination of both hardware and software elements. It should be noted that FIG. 9 is merely one example of a particular implementation and is merely intended to illustrate the types of components that may be present in the electronic device 10. For example, in the illustrated embodiment, these components may include a display 16, input/output (I/O) ports 14, input structures 12, one or more processors 18, memory device(s) 20, non-volatile storage 22, expansion card(s) 24, RF circuitry 26, and power source 28.

In the embodiment of the electronic device 10 in the form of a computer, the embodiment include computers that are generally portable (such as laptop, notebook, tablet, and handheld computers), as well as computers that are generally used in one place (such as conventional desktop computers, workstations, and servers).

The electronic device 10 may also take the form of other types of devices, such as mobile telephones, media players, personal data organizers, handheld game platforms, cameras, and/or combinations of such devices. For instance, the device 10 may be provided in the form of a handheld electronic device that includes various functionalities (such as the ability to take pictures, make telephone calls, access the Internet, communicate via email, record audio and/or video, listen to music, play games, connect to wireless networks, and so forth).

In another embodiment, the electronic device 10 may also be provided in the form of a portable multi-function tablet computing device. In certain embodiments, the tablet computing device may provide the functionality of media player, a web browser, a cellular phone, a gaming platform, a personal data organizer, and so forth.

An embodiment of the invention may be a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other embodiments, some of these operations might be performed by specific hardware components that contain hardwired logic. Those operations might alternatively be performed by any combination of programmable computer components and fixed hardware circuit components. In one embodiment, the machine-readable medium includes instructions stored thereon, which when executed by a processor, causes the processor to perform the method of optimizing beamformers for echo control on an electronic device as described above.

In the description, certain terminology is used to describe features of the invention. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

What is claimed is:

1. An apparatus for optimizing beamformers for echo control comprising:

a plurality of microphones to receive acoustic signals;

a plurality of echo cancellers (ECs) coupled to the plurality of microphones, respectively, to adaptively cancel echo in the acoustic signals and to generate EC-acoustic signals; and a first fixed beamformer coupled to the plurality of ECs to receive the EC-acoustic signals, wherein a null of the first fixed beamformer is steered in a direction of a first environmental noise source, wherein the first environmental noise source is determined offline by:

exciting the ECs with normal speech signals and audio playback signals to cause the ECs to generate test EC-acoustic signals, and selecting the first environmental noise source based on loudness weighted centroids of noise in the test EC-acoustic signals.

2. The apparatus of claim 1, further comprising:

a residual echo suppressor coupled to the first fixed beamformer to perform echo suppression on an output of the first fixed beamformer and to generate a clean signal.

3. The apparatus of claim 1, wherein the EC-acoustic signals comprise a plurality of environmental noise sources including the first environmental noise source.

4. The apparatus of claim 3, wherein selecting the first environmental noise source further comprises determining a statistical occurrence of each of the environmental noise sources, determining the loudness of each of the environmental noise sources, and determining the perceptual impact of each of the environmental noise sources.

5. The apparatus of claim 3, further comprising:

a loudspeaker to output a loudspeaker signal that includes a downlink audio signal from a far-end talker, wherein the first environmental noise is the output from the loudspeaker.

6. The apparatus of claim 3, wherein selecting the first environmental noise source includes selecting from the plurality of environmental noise sources the environmental noise source having a highest power in the EC-acoustic signals.

7. The apparatus of claim 3, further comprising:

a second fixed beamformer coupled to the plurality of echo cancellers to receive the EC-acoustic signals, wherein a null of the second fixed beamformer is steered in a direction of a second environmental noise source included in the plurality of environmental noise sources, wherein the second environmental noise source is determined offline by:

exciting the ECs with normal speech signals and audio playback signals to cause the ECs to generate test EC-acoustic signals, and selecting the second environmental noise source based on loudness weighted centroids of noise in the test EC-acoustic signals.

8. The apparatus of claim 7, further comprising:

a selector coupled to the first and the second fixed beamformers, wherein the selector selects and outputs one of an output of the first fixed beamformer or an output of the second fixed beamformer.

9. The apparatus of claim 8, further comprising:

a residual echo suppressor coupled to the selector to perform echo suppression on an output of the selector and generate a clean signal.

10. A method of optimizing beamformers for echo control comprising:

setting a null of a first fixed beamformer offline, wherein setting the null of the first fixed beamformer includes:

(i) determining a first environmental noise source offline by:

exciting a plurality of echo cancellers (ECs) coupled to a plurality of microphones, respectively, with normal speech signals and audio playback signals to cause the ECs to generate test EC-acoustic signals, and selecting the first environmental noise source based on loudness weighted centroids of noise in the test EC-acoustic signals, and (ii) setting a null of the first fixed beamformer in a direction of the first environmental noise source;

adaptively cancelling by the ECs echo in acoustic signals received from the plurality of microphones to generate EC-acoustic signals; and receiving the EC-acoustic signals by the first fixed beamformer and steering the null of the first fixed beamformer in the direction of the first environmental noise.

11. The method of claim 10, further comprising:

receiving an output of the first fixed beamformer by a residual echo suppressor;

performing echo suppression by the first fixed beamformer on the output of the first fixed beamformer to generate a clean signal.

12. The method of claim 10, wherein the EC-acoustic signals comprise a plurality of environmental noise sources including the first environmental noise source.

13. The method of claim 12, wherein selecting the first environmental noise source further comprises determining a statistical occurrence of each of the environmental noise sources, determining the loudness of each of the environmental noise sources, and determining the perceptual impact of each of the environmental noise sources.

14. The method of claim 12, wherein the first environmental noise is an output from a loudspeaker, wherein the loudspeaker outputs a loudspeaker signal that includes a downlink audio signal from a far-end talker.

15. The method of claim 12, wherein selecting the first environmental noise source includes selecting from the plurality of environmental noise sources the environmental noise source having a highest power in the EC-acoustic signals.

16. The method of claim 12, further comprising:

setting a null of a second fixed beamformer offline, wherein setting the null of the second fixed beamformer includes:

(i) determining a second environmental noise source included in the plurality of environmental noise sources offline by:

exciting a plurality of echo cancellers (ECs) coupled to a plurality of microphones, respectively, with normal speech signals and audio playback signals to cause the ECs to generate test EC-acoustic signals, and selecting the second environmental noise source based on loudness weighted centroids of noise in the test EC-acoustic signals, and (ii) setting a null of the second fixed beamformer in a direction of the second environmental noise source.

17. The method of claim 16, further comprising:

selecting and outputting by a selector one of an output of the first fixed beamformer or an output of the second fixed beamformer.

18. The method of claim 17, further comprising:

performing by a residual echo suppressor echo suppression on an output of the selector to generate a clean signal.

19. A non-transitory computer-readable storage medium having instructions stored thereon, which when executed by a processor, causes the processor to perform a method of optimizing beamformers for echo control comprising:

setting a null of a first fixed beamformer offline, wherein setting the null of the first fixed beamformer includes:

(i) determining a first environmental noise source offline by:

exciting a plurality of echo cancellers (ECs) coupled to a plurality of microphones, respectively, with normal speech signals and audio playback signals to cause the ECs to generate test EC-acoustic signals, and selecting the first environmental noise source based on loudness weighted centroids of noise in the test EC-acoustic signals, and (ii) setting a null of the first fixed beamformer in a direction of the first environmental noise source;

signaling to the ECs to adaptively cancel echo in acoustic signals received from the plurality of microphones to generate EC-acoustic signals; and transmitting the EC-acoustic signals to the first fixed beamformer and steering the null of the first fixed beamformer in the direction of the first environmental noise.

20. The non-transitory computer-readable storage medium of claim 19, wherein the EC-acoustic signals comprise a plurality of environmental noise sources including the first environmental noise source.

21. The non-transitory computer-readable storage medium of claim 20, wherein the processor to perform the method further comprising:

setting a null of a second fixed beamformer offline, wherein setting the null of the second fixed beamformer includes:

(i) determining a second environmental noise source included in the plurality of environmental noise sources offline by:

exciting a plurality of echo cancellers (ECs) coupled to a plurality of microphones, respectively, with normal speech signals and audio playback signals to cause the ECs to generate test EC-acoustic signals, and selecting the second environmental noise source based on loudness weighted centroids of noise in the test EC-acoustic signals, and (ii) setting a null of the second fixed beamformer in a direction of the second environmental noise source.

22. The non-transitory computer-readable storage medium of claim 21, wherein the processor to perform the method further comprising:

selecting and outputting by a selector one of an output of the first fixed beamformer or an output of the second fixed beamformer.

23. The non-transitory computer-readable storage medium of claim 22, wherein the processor to perform the method further comprising:

performing by a residual echo suppressor echo suppression on an output of the selector to generate a clean signal.

* * * * *